US005728969A

United States Patent [19]

Otani et al.

[11] Patent Number: 5,728,969

[45] Date of Patent: Mar. 17, 1998

[54] PREPARATION OF AN-DNT-AL EXPLOSIVE

[75] Inventors: Koichi Otani; Seiichi Yoshida, both of Kitakyushu; Yoshiyuki Ikeda; Hiroyuki Taniguchi, both of Ube, all of Japan

[73] Assignees: Mitsubishi Chemical Corporation; Nippon Kayaku Kabushiki Kaisha, both of Tokyo, Japan

[21] Appl. No.: 813,854

[22] Filed: Mar. 7, 1997

Related U.S. Application Data

[62] Division of Ser. No. 509,989, Aug. 1, 1995, Pat. No. 5,675,119.

[30] Foreign Application Priority Data

Dec. 8, 1994 [JP] Japan ..... 190423/94

[51] Int. Cl.[6] ..... C06B 21/00

[52] U.S. Cl. ..... 149/109.6; 149/7; 149/8; 149/56; 149/105

[58] Field of Search ..... 149/7, 8, 56, 105, 149/109.6

[56] References Cited

U.S. PATENT DOCUMENTS

| | | | |
|---|---|---|---|
| 2,220,891 | 11/1940 | Cook et al. | 52/14 |
| 3,722,410 | 3/1973 | Hurst | 102/23 |
| 3,773,573 | 11/1973 | Slykhouse | 149/2 |
| 3,937,296 | 2/1976 | Larson | 181/118 |
| 4,015,526 | 4/1977 | Bond et al. | 102/21.6 |
| 4,084,993 | 4/1978 | Cook | 149/39 |
| 4,084,995 | 4/1978 | Samuelsen et al. | 149/105 |
| 4,093,478 | 6/1978 | Hurst | 149/2 |
| 4,334,939 | 6/1982 | Bushman | 149/21 |

FOREIGN PATENT DOCUMENTS 58-145686 8/1983 Japan .

*Primary Examiner*—Edward A. Miller
*Attorney, Agent, or Firm*—Nields, Lemack & Dingman

[57] ABSTRACT

A granular explosive is obtained by mixing porous prill ammonium nitrate having an average particle size of 0.5 to 3.0 mm with a liquid aromatic dinitro compound and optionally a metal powder. Explosives having high sensitivity and power can be obtained by a simple and easy process.

5 Claims, No Drawings

PREPARATION OF AN-DNT-AL EXPLOSIVE

This application is a divisional of application Ser. No. 08/509,989 filed Aug. 1, 1995, now U.S. Pat. No. 5,675,119.

[FIELD OF THE INVENTION]

This invention relates to explosives which find versatile use in blasting operations such as quarrying, mining, tunnel boring and the like.

[PRIOR ART]

Dynamite, watergel (slurry explosive, emulsion explosive), ammonium nitrate explosive, ANFO explosive and the like are well known as explosives for use in blasting operations. Of these explosives, ammonium nitrate explosive and ANFO explosive are composed of relatively inexpensive raw materials, including ammonium nitrate as the main component. The former is a cap sensitive type explosive which explodes with one commercially available No.6 cap, and the latter is a so-called booster sensitive type explosive which does not explode with a single cap.

The ANFO explosive, produced by adding a liquid fuel such as light oil or the like to porous prill ammonium nitrate having a particle size of about 1 to 2 mm is characterized by its cheap raw materials and simple production steps. This explosive, however, has such a low sensitivity that it does not explode with a single No.6 cap, so that it is absolutely necessary to use a No.6 cap sensitive type explosive as a booster, which is troublesome.

On the other hand, ammonium nitrate explosive has a high sensitivity of being exploded by a single No.6 cap, but, as is evident from literatures on general explosives and JP-A-58-145686 (1983) (the term "JP-A" as used herein means an "unexamined published Japanese patent application") and the like, it is necessary to mix ammonium nitrate and a fuel material for a prolonged period of time using an edge runner or a ball mill, with heating in some cases, thus posing a problem in that the production process requires a long period and is complex.

[DISCLOSURE OF THE INVENTION]

With the aim of obtaining a highly sensitive and highly powerful explosive using inexpensive raw materials by a simple process, the inventors of the present invention have conducted intensive studies and found that an explosive produced by mixing porous prill ammonium nitrate having an average particle size of 0.5 to 3.0 mm with one or more liquid aromatic dinitro compounds shows higher sensitivity than that of the prior art ANFO explosive. The present invention has been accomplished on the basis of this finding.

Accordingly, the present invention relates to (1) a granular explosive comprising porous prill ammonium nitrate which has an average particle size of 0.5 to 3.0 mm and is mixed with an aromatic dinitro compound which is in the liquid form at the time of mixing;

(2) a granular explosive comprising porous prill ammonium nitrate which has an average particle size of 0.5 to 3.0 mm and is mixed with a metal powder and an aromatic dinitro compound which is in the liquid form at the time of mixing;

(3) a granular explosive according to (2) above wherein said metal powder is aluminum powder;

(4) a granular explosive according to (1) or (2) above wherein said porous prill ammonium nitrate has an oil absorbency of 15 to 24% by weight;

(5) a powder explosive which is obtained by pulverizing the granular explosive of (1), (2) or (3) above; or (6) a powder explosive according to (5) above wherein said particle size obtained after pulverizing is from 0.05 mm to 0.3 mm.

The following describes the present invention in detail.

The porous prill ammonium nitrate to be used in the present invention may have an average particle size of preferably from 0.5 to 3.0 mm and an oil absorbency of generally from 5 to 25% by weight, preferably from 15 to 24% by weight.

The oil absorbency of ammonium nitrate is calculated in accordance with the procedure established by Commercial Explosive Association, by soaking a predetermined amount of an ammonium nitrate sample in light oil for a predetermined period, collecting the soaked sample by suction filtration and then calculating the amount of absorbed oil from the difference in weight before and after the test. Practical measurement is carried out as follows.

A 50 g portion of an ammonium nitrate sample is put into a glass filter (11G-1) having a diameter of 40 mm and a depth of 50 mm and weighed using an direct-reading even balance, and the resulting filter is arranged on a vacuum device. Next, 40 ml of light oil is poured into the glass filter and thoroughly stirred using a thin stick to effect mixing and contact of ammonium nitrate and light oil. After 5 minutes of standing, a lower cock attached to the glass filter is opened to allow the light oil to drop out spontaneously for 2 minutes. After subsequent 5 minutes of suction at a rate of about 30 L/min using a vacuum pump, the glass filter containing the light oil-absorbed ammonium nitrate sample is weighed on the direct-reading even balance. After completion of the measurement, ratio (%) of the weight gain (g) by the absorbed light oil to 50 g of the original ammonium nitrate sample is expressed as the oil absorbency as follows.

$$\text{Oil absorbency (\%)} = \frac{\text{weight gain (g)}}{\text{sample 50 g}} \times 100$$

According to the granular or powder explosive of the present invention, the porous prill ammonium nitrate having an average particle size of 0.5 to 3.0 mm is used in an amount within the range of from 50 to 97% by weight, preferably from 70 to 95% by weight, based on the total explosive.

Illustrative examples of the aromatic dinitro compound to be used in the present invention include dinitrobenzene, dinitrochlorobenzene dinitrotoluene, dinitroxylene, dinitrophenol, dinitronaphthalene and the like. The dinitro compound may be used alone or in the form of mixture of dinitrocompound isomers or blend of such isomers. Usually, dinitro compounds having low melting points (lower than about 100° C.) are used alone and dinitro compounds having high melting points (upper than about 100° C.) are used by mixing its isomers to obtain low melting points, preferably lower than 100° C. These aromatic dinitro compounds are contained in the granular explosive of the present invention in an amount of from 3 to 50% by weight, preferably from 5 to 30% by weight.

When the aromatic dinitro compound is mixed in the explosive of the present invention, it is essential to add the compound in the liquid form, by melting it with heating when it is solid at ordinary temperature. Addition of the compound in the liquid form renders possible its quick adsorption to and further permeation into the porous prill ammonium nitrate, thus effecting improvement of the sensitivity of the product. The mixing may be carried out at a temperature within the range of from room temperature to less than 160° C., preferably less than 100° C., more preferably 50° to 100° C.

The explosive of the present invention is produced by mixing the porous prill ammonium nitrate with the aromatic dinitro compound using a mixer such as a kneader or rotary mixer. After completion of the mixing, the resulting mixture is recovered from the mixer as the granular explosive of the present invention. At the time of the mixing, other fuel materials or metal powders may be added which will be described later.

The powder explosive of the present invention is produced by pulverizing the thus obtained granular explosive of the present invention using a pulverizing machine such as a grinding machine, an edge runner, a ball mill or the like. The average particle size of the powder explosive of the present invention is preferably 0.05 to 0.3 mm.

In order to adjust oxygen balance, power and the like, other fuel materials than the aromatic dinitro compound, such as carbon powder, coal powder, wood flour and the like, may be added optionally to the explosive of the present invention at the time of the mixing.

In order to improve sensitivity and power, a metal powder may be added to the explosive of the present invention when or after the porous prill ammonium nitrate is mixed with the aromatic dinitro compound. Examples of the metal powder include those which are conventionally used in explosives, such as powders of aluminium, magnesium, iron, ferro silicon, magnalium and the like. The metal powder to be used herein may have a wide range of particle sizes. In general, however, the metal powder contributes not to the sensitivity improvement but to the power improvement when its particle size is large, while it contributes to the improvement of both sensitivity and power when its particle size becomes small. According to the present invention, the metal powder having a particle size of generally from 4 to 500 μm, preferably from 10 to 200 μm, is used in an amount of from 0.5 to 20% by weight.

When aluminium powder is used as the metal powder, the sensitivity- and power-improving effects become especially remarkable. The aforementioned effects of particle sizes can be found also in the case of aluminium powder, and the sensitivity is markedly improved when its particle size is small. In addition, the sensitivity-improving effect becomes particularly significant when a scale-shaped aluminium powder, so-called flake aluminium, is used. Though not particularly limited, it is desirable to use the aluminium powder in an amount of from 0.5% to 15% by weight, in view of the oxygen equilibrium of the explosive and its cost.

The explosive of the present invention in which porous prill ammonium nitrate having an average particle size of 0.5 to 3.0 mm is mixed with a single aromatic dinitro compound or two or more aromatic dinitro compounds is characterized in that it has high sensitivity and power and its production process is simple. In addition, sensitivity and performance of the explosive of the present invention can be improved more greatly by the addition of a metal powder as an additional component.

[EXAMPLES]

Examples of the present invention are given below by way of illustration and not by way of limitation. "Part" used herein is based on weight.

Example 1

Eighty-six (86) parts of porous prill ammonium nitrate (average particle size, 1.5 mm; oil absorbency, 12.5%) and 14 parts of a mixture which is prepared by mixing a dinitrotoluene mixture (mp about 50° C.) with a dinitroxylene mixture (mp about −5° C.) at a weight ratio of 60:40 and heated at 25° C. were thoroughly mixed using a horizontal kneader equipped with a sigma wing, thereby obtaining a granular explosive of the present invention. A 100 g portion of the thus obtained granular explosive was recovered from the kneader and packed in a paper shell of 30 mm in diameter. Particle size of the explosive was found to be 1.5 mm.

Example 2

Eighty-six (86) parts of porous prill ammonium nitrate (average particle size, 1.5 mm; oil absorbency, 12.5%) and 14 parts of dinitroxylene mixture at room temperature were mixed in the same manner as described in Example 1 and packed in a paper shell.

Example 3

Eighty-six (86) parts of porous prill ammonium nitrate (average particle size, 1.7 mm; oil absorbency, 17%) and 14 parts of dinitrotoluene mixture which has been liquidized by heating at 70° C. were mixed in the same manner as described in Example 1 to obtain a granular explosive of the present invention, and the explosive was packed in a paper shell.

Example 4

Eighty-six (86) parts of porous prill ammonium nitrate (average particle size, 1.3 mm; oil absorbency, 23%) and 14 parts of dinitrotoluene mixture which has been liquidized by heating it at 70° C. were mixed in the same manner as described in Example 1 to obtain a granular explosive of the present invention. This was transferred into a ball mill and pulverized to obtain a powder explosive of the present invention. The particle size is 0.1 mm. A 100 g portion of the thus obtained powder explosive was packed in a paper shell of 30 mm in diameter.

Example 5

Eighty-five (85) parts of porous prill ammonium nitrate (average particle size, 1.5 mm; oil absorbency, 12.5%), 14 parts of a mixture prepared by mixing a dinitrotoluene mixture and a dinitroxylene mixture at a weight ratio of 60:40 and 1 part of flake-shaped aluminium (trade name, P-0100; manufactured by Toyo Aluminium) were thoroughly mixed using a bench kneader equipped with a sigma wing, thereby obtaining a granular explosive of the present invention. A 100 g portion of the thus obtained explosive was recovered from the kneader and packed in a paper shell of 30 mm in diameter.

Example 6

Eighty-five (85) parts of porous prill ammonium nitrate (average particle size, 1.7 mm; oil absorbency, 17%), 14 parts of a dinitrotoluene mixture which has been liquidized by heating it at 70° C. and 1 part of atomized aluminium (trade name, AC-0460; manufactured by Toyo Aluminium) were mixed in the same manner as described in Example 5 to obtain a granular explosive of the present invention. The thus obtained explosive was packed in a paper shell.

Example 7

Eighty-five (85) parts of porous prill ammonium nitrate (average particle size, 1.7 mm; oil absorbency, 17%) placed at room temperature, 14 parts of a dinitrotoluene mixture which had been liquidized by heating it at 70° C. and 1 part of flake-shaped aluminium (trade name, P-0100; manufactured by Toyo Aluminium) were mixed in the same manner as described in Example 5 to obtain a granular explosive of the present invention. The thus obtained explosive was packed in a paper shell.

Example 8

Eighty-five (85) parts of porous prill ammonium nitrate (average particle size, 1.7 mm; oil absorbency, 17%) preheated to 70° C. and 14 parts of a liquid dinitrotoluene mixture which was prepared by mixing 2,6-dinitrotoluene with dinitrotoluene and heating at 70° C. were thoroughly mixed using a horizontal kneader equipped with a sigma wing, thereby obtaining a granular explosive of the present invention. After cooling, the granular explosive and 1 part of flake-shaped aluminium (P-0100; manufactured by Toyo Aluminium) were mixed using a horizontal kneader. The thus obtained explosive was recovered from the kneader and packed in a paper shell.

Performance Tests

The explosives packed in paper shells, obtained in Examples 1 to 8, were subjected to the following performance tests. The results are summarized in Table 1.

(1) Detonation test

Using various caps, detonation test was carried out to examine sensitivity of each explosive in accordance with the Weak-cap Test defined in the Industrial Explosive Society Standard ES-32(5).

(2) Ballistic pendulum test

Ballistic pendulum test was carried out using No.6 cap to measure ballistic pendulum values (explosives of Examples 1 and 2 were not tested because they did not explode with the No.6 cap).

(3) Workability test

A 10 kg portion of each explosive was separately produced by two workers in accordance with the methods of Examples 1 to 8, and the time required for its production starting from the preparation of raw materials until completion of the cartridge production was measured.

TABLE 1

| | Results of performance tests | | | | | | | |
|---|---|---|---|---|---|---|---|---|
| | Examples | | | | | | | |
| Example No. | 1 | 2 | 3 | 4 | 5 | 6 | 7 | 8 |
| Cap No. for complete explosion | No. 8 | No. 8 | No. 6 | No. 3 | No. 6 | No. 6 | No. 3 | No. 0 |

TABLE 1-continued

| | Results of performance tests | | | | | | | |
|---|---|---|---|---|---|---|---|---|
| | Examples | | | | | | | |
| Example No. | 1 | 2 | 3 | 4 | 5 | 6 | 7 | 8 |
| Ballistic pendulum value | — | — | 70 mm | 70 mm | 72 mm | 75 mm | 75 mm | 75 mm |
| Time required for 10 kg production | 2 hrs | 2 hrs | 2.5 hrs | 3 hrs | 2.2 hrs | 2.7 hrs | 2.7 hrs | 3.0 hrs |

As is evident from the results shown in the above table, the explosive of the present invention is characterized in that it has high sensitivity and can be produced within a markedly short working time. In addition, the sensitivity-improving effect of aluminium powder is apparent from the comparison of Example 1 with Example 5 and Example 3 with Examples 7 and 8, and the power-improving effect of aluminium powder is also apparent from the comparison of Example 3 with Examples 6 to 8. Further, the sensitivity-improving effect realized by preheating the porous prill ammonium nitrate to the temperature of the dinitrotoluene mixture liquidized by heating is apparent from the comparison of Example 7 with Example 8.

[EFFECTS OF THE INVENTION]

Granular or powder explosives excellent in sensitivity and power can be produced easily.

What is claimed is:

1. A method of preparing a granular explosive comprising porous prill ammonium nitrate having an average particle size of 0.5 to 3.0 mm a metal powder and an aromatic dinitro compound having a melting point of 50° to 100° C., said method comprising:

melting said aromatic dinitro compound;

mixing said porous prill ammonium nitrate with said melted aromatic dinitro compound;

cooling the resultant mixture; and further mixing the cooled mixture with said metal powder.

2. The method of claim 1, wherein said metal powder is aluminum powder.

3. The method of claim 1, further comprising pulverizing granular explosive into a powder.

4. The method of claim 1, wherein said particle size obtained after pulverizing is from 0.05 mm to 0.3 mm.

5. The method of claim 1, wherein said porous prill ammonium nitrate has an oil absorbency of 15 to 24% by weight.

* * * * *

UNITED STATES PATENT AND TRADEMARK OFFICE

CERTIFICATE OF CORRECTION

PATENT NO. : 5,728,969

DATED : March 17, 1998

INVENTOR(S) : Koichi Otani, et al.

It is certified that error appears in the above-identified patent and that said Letters Patent is hereby corrected as shown below:

Foreign Application Priority Data

August 12, 1994 [JP] Japan .....190423/94

Signed and Sealed this

Sixteenth Day of June, 1998

*Attest:*

*Attesting Officer*

BRUCE LEHMAN

*Commissioner of Patents and Trademarks*